US005938148A

United States Patent [19]

Orenstein

[11] Patent Number: 5,938,148

[45] **Date of Patent: *Aug. 17, 1999**

[54] GUIDANCE SYSTEM FOR AIR-TO-AIR MISSILES

[75] Inventor: Itai Orenstein, Tel-Aviv, Israel

[73] Assignee: Israel Aircraft Industries, Ltd., Ben Gurion, Israel

[ * ] Notice: This patent issued on a continued prosecution application filed under 37 CFR 1.53(d), and is subject to the twenty year patent term provisions of 35 U.S.C. 154(a)(2).

[21] Appl. No.: 08/819,267

[22] Filed: Mar. 18, 1997

[30] Foreign Application Priority Data

Mar. 21, 1996 [IL] Israel ..... 117589

[51] Int. Cl.[6] ..... F41G 7/00

[52] U.S. Cl. ..... 244/3.15

[58] Field of Search ..... 244/3.11, 3.15, 244/3.16, 3.19, 3.13, 3.14

[56] References Cited

U.S. PATENT DOCUMENTS

| | | | |
|---|---|---|---|
| 3,876,308 | 4/1975 | Alpers | 244/3.16 |
| 4,168,813 | 9/1979 | Pinson et al. | 244/3.16 |
| 4,318,515 | 3/1982 | Leek | 244/3.16 |
| 4,324,491 | 4/1982 | Hueber | 244/3.16 |
| 4,741,245 | 5/1988 | Malone . | |
| 4,856,733 | 8/1989 | Lachmann . | |
| 4,925,129 | 5/1990 | Salkeld et al. . | |
| 5,102,065 | 4/1992 | Couderc et al. | 244/3.11 |
| 5,187,485 | 2/1993 | Tsui et al. . | |
| 5,310,134 | 5/1994 | Hsu et al. | 244/3.12 |
| 5,340,056 | 8/1994 | Guelman et al. . | |
| 5,379,966 | 1/1995 | Simeone et al. | 244/3.11 |
| 5,424,744 | 6/1995 | Westphal . | |
| 5,430,449 | 7/1995 | Frazho et al. | 244/3.15 |
| 5,458,041 | 10/1995 | Sun et al. | 244/3.16 |
| 5,554,994 | 9/1996 | Schneider | 244/3.19 |
| 5,647,560 | 7/1997 | Schnatz et al. | 244/3.15 |

FOREIGN PATENT DOCUMENTS

| | | |
|---|---|---|
| 2 389 307 | 11/1978 | France . |
| 2 708 117 | 1/1995 | France . |
| 4139400 | 5/1992 | Japan . |

OTHER PUBLICATIONS

*Aviation Week and Space Technology,* pp. 36–49, Oct. 16, 1995, "U.S. Intensifies Efforts to Meet Missile Thread", Michael A. Dornheim, et al.

*Primary Examiner*—Charles T. Jordan
*Assistant Examiner*—Theresa M. Wesson
*Attorney, Agent, or Firm*—Oliff & Berridge

[57] ABSTRACT

A method and system for providing navigational data required to guide an air-to-air missile to a target. The missile is equipped either with an infrared seeking sensor or a radar system. The trajectory of the target is predicted on the basis of a series of location measurements. A flight path of the missile is predicted such that the missile will intercept the target. Based on the predicted missile flight path, signals corresponding to the required rotational angle of the missile's sensor or radar antenna are generated and supplied to the sensor or radar's rotation control unit to cause the missile to move along the predicted flight path.

35 Claims, 7 Drawing Sheets

GUIDANCE SYSTEM FOR AIR-TO-AIR MISSILES

FIELD AND BACKGROUND OF THE INVENTION

The present invention relates to guidance systems for air-to-air missiles equipped with infrared seeking sensors or radar systems.

The operation of conventional air-to-air missile guidance systems used in missiles with infrared seeking sensors or radars is well known. Most of these missiles operate in a "fire and forget mode". At the time of launching of a missile from an aircraft the target is brought into the field of view of the sensor, or radar antenna, of the missile. Once the missile is launched it uses its self-guidance system to track and then home in on the target by maintaining the target at the center of its field of view by continually updating the missile's flight path.

For the specific example of missile's equipped with infrared seeking sensors the process of updating the missile's flight path is as follows. At the time of launching the sensor is directed substantially towards the target so that an infrared radiating "hot" spot of the target is located at, or near, the center of its field of view. As the target moves away from the center of the field of view of the missile's sensor so that the missile's flight path correspondingly moves off target, the sensor rotates independently of the missile's body to bring the target's infrared radiating hot spot back into the center of its field of view. A signal representative of the spatial rotation angle through which the sensor rotated during this manoeuvre is transmitted to a control unit which in turn operates the missile's steering system which, by way of a non-limiting example, activates the missile's fins to re-align the missile thereby ensuring that its flight path is again on target. This procedure of rotation of the missile's sensor and re-aligning of the missile, has to be performed continuously, or quasi-continuously, since a missile cannot make sudden changes in direction, i.e., its flight path is always smooth, even though the missile's sensor is fitted on gimbals that allow for fairly large angles of rotation.

Missiles fitted with sensors that are capable of rotating independently of the missile and therefore "seeing" targets that are off boresight are termed "off-boresight missiles". The angle through which the seeker rotates from boresight is termed the "off-boresight angle". For a review of the properties of various high performance short-range off-boresight missiles see: Aviation Week and Space Technology, pp. 36–49, Oct. 16, 1995, the field of view of the sensor is relatively small (about 3°). Hence, in order for the missile not to completely "lose sight" of the target, the updating of the missile's flight path has to be continuously performed. The process involved in updating an air-to-air missile equipped with a radar system is similar, the main difference being that in this case the target is maintained at the center of the field of view of the radar's antenna by maintaining a maximum target echo as received by the radar system.

There are, therefore, clearly a number of serious drawbacks with conventional fire and forget missiles. For a start, the missile has to be in a "seek mode" from the moment of launching. Hence, for such missiles the target cannot be outside the field of view of the missile either at the time of launching of the missile, or at any time after launching. This means that targets outside of the field of view of the missile, e.g., behind or on a side of the aircraft (i.e., at an angle of greater than 90° from boresight), on which the missile is mounted, cannot be acquired by the missile at the time of launching. Another drawback of such missiles is that should the target escape completely from the missile's field of view after launch, there is no way to set the missile back on a homing flight path toward the target. Another well known drawback is the susceptibility of these missiles to counter measures, which normally take the form of flares for infrared seeking missiles and chaff for missile's equipped with radars. In both of these cases the counter measures act as decoys which, as far as the missiles are concerned, are valid targets.

Although future missile systems are planned to include various Counter Counter Measures (CCM), e.g. CCM's which utilize micro processors for comparing various characteristics of the decoy with those of the target (e.g., for the infra red sensor case these characteristics could be, the spectrum, intensity and velocity of the radiation emitted by a flare and by the exhaust of the target), they would require mounting an appropriate sub-system on a missile. Needles to say, that existing missiles would have to be fitted with such a sub-system in order to enjoy decoy counter countermeasure capability.

A further and well known problem of off-boresight missiles is that if in the pursuit of a target they do make a sudden large angled turn (e.g., just after launch) they could well lock on to a friendly aircraft. The ability to distinguish between friendly aircraft and enemy targets (whether aircraft or missiles) so as to avoid friendly fire situations is would clearly a desirable feature of such missiles.

Even in apparently favorable situations wherein the target is in the field of view of the missile's sensor the infrared signal reaching the missile from the target may be very weak. Such a situation could arise when, for example, the target is approaching the missile so that the target's hot spot (at its rear) is effectively hidden from the sensor's field of view.

Therefore a need exists for missile guidance systems that can track and home in on a target situated outside the field of view of the missile either at the time of launching of the missile, or at any time after launching. Another need exists for missile guidance systems that can track and home in on a target even in the presence of decoy counter measures, or when the signal from the target that is detected by the sensor is very weak. Preferably, the proposed missile guidance system should inherently incorporate in it counter countermeasure capability, without the necessity of an additional CCM sub-system.

SUMMARY OF THE INVENTION

It is an object of the present invention to provide a guidance system for air-to-air missiles equipped with infrared seeking sensors, or radar systems, that can provide navigational data required to guide the missile towards the target when the target is within the missile's sensor's field of view but the signal (infrared radiation for infrared sensors or radar return for radar systems) received by the sensor from the target is low to a degree that does not allow the self-guidance system of the missile to operate accurately or at all, or when the target is outside the field of view of the missile.

It is a further object of the present invention to provide a guidance system for air-to-air missiles equipped with infrared seeking sensors, or radar systems, that can provide navigational data required to determine if a missile is homing in on a decoy or another friendly aircraft instead of a target and appropriately correct the flight path to put the missile back on target.

In the following description and appended claims the term "sensor" will be used to denote both an infrared sensor mounted in a missile and a radar antenna connected to a radar system mounted in a missile. When the "sensor" is rotated through a given angle, it will be understood that for the case of a missile equipped with an infrared seeking sensor it is the sensor that is rotated through the given angle, whereas in the case of a missile equipped with a radar system it is the radar's antenna that is rotated through the given angle. Furthermore, it is appreciated that the missile can operate in various guidance "modes of operation". The conventional mode of operation being when the missile uses its own guidance system without any outside assistance. This is termed the "normal seek mode". The guidance system of the invention two additional modes of operation which are not found in conventional missile guidance systems, termed herein the "non-seek mode" and the "dual seek mode". In the former the missile's sensor is "turned off" (i.e. it does not perform the operation of seeking) and the missile is guided completely by line of sight commands received from outside the missile and applied to the missile's sensor, hence mimicking the normal seek mode. The "line of sight" of the missile'sensor is defined by the unit vector along the line of sight connecting the center of sensor to the object detected by the sensor. The line of sight can also be interpreted in terms of the polar angles (or spatial rotation angle of the sensor) defining the unit vector along the line of sight, with reference to a missile-fixed coordinate system. In this case the missile's boresight is normally taken as the direction for which both polar angles of the unit vector along the line of sight are zero. In the dual seek mode of operation the missile uses its own guidance system, i.e. the sensor is in the seek mode, while at the same time receiving line of sight commands, which accordingly cause the sensor to rotate and which override the seek mode operation of the sensor if the sensor has been determined to be "looking" in the wrong direction. This mode is used for overcoming decoy countermeasures (or friendly fire situations) by correcting the missile's trajectory so that it will home in on the target and not on the decoy (or friendly aircraft).

In accordance with a first embodiment of the present invention there is provided, for guiding a missile equipped with a sensor towards a target, a guidance system, comprising:

a Global Positioning System (GPS) receiver mounted in the missile operative to receive GPS data from Global Positioning System satellites;

a transmitter mounted in the missile for transmitting to an aircraft said GPS data and present sensor line of sight data;

a receiver mounted in the missile for receiving determined sensor line of sight data and sensor mode of operation data from the aircraft;

a receiver mounted in the aircraft for receiving from the missile said GPS data and said present sensor line of sight data;

location determination means mounted in the aircraft for determining location data of the missile from said GPS data received by the aircraft from the missile;

self-location determination means mounted in the aircraft for determining the aircraft's self-location;

relative location determination means mounted in the aircraft coupled to said location determination means and to said self-location determination means and responsive to missile location data and to self-location data for determining the location of the missile relative to the location of the aircraft;

a radar system mounted in the aircraft for locating and tracking a target and for determining the location of the target;

trajectory analysis means mounted in the aircraft coupled to said radar system and to said relative location determination means and responsive to target and missile location data for predicting the trajectory of the target and for determining the trajectory of the missile required to ensure that the missile will intercept the target and for specifying the sensor mode of operation;

line of sight determination means mounted in the aircraft coupled to said trajectory analysis means and responsive to the determined missile trajectory data and to missile location data for determining the sensor line of sight required to guide the missile along the determined missile trajectory;

a transmitter mounted in the aircraft for transmitting said determined line of sight data and the specified sensor operational mode data from the aircraft to the missile; and means mounted in the missile for conveying said determined sensor line of sight data to the missile's sensor rotation control unit and responsive, when operating in the non-seek mode, to said sensor operational mode data whereby the sensor rotates into the determined sensor line of sight.

when the missile operates in the normal seek mode it uses its self-guidance system and tracks and homes in on the target by maintaining the target at the center of its field of view as described hereinbefore. In accordance with the first embodiment of the invention the missile can operate in a non-seek mode for part of, or possibly all of, the acquisition period. When operating in the non-seek mode the missile's sensor is switched off and the "seeking" is performed externally by the guidance system of the invention which, from the acquired location data of the missile and the target, determines the line of sight data (i.e., the polar angles through which the missile's sensor has to be rotated relative to the axis of the missile) required in order to guide the missile along a flight path towards the target. The determined line of sight data is conveyed to the sensor rotation control unit which rotates the sensor into the determined line of sight, hence imitating the normal seek mode. As in the case of the normal seek mode, signals are sent to the missile's steering system, in response to the rotation of the sensor, so as to direct the missile into the present sensor line of sight. When the flight path of the missile is curved this process is constantly performed in order to ensure that the missile will eventually intercept the target. However, as pointed out, the non-seek mode does not necessarily have to be applied right through to the point of interception.

Typically, the missile operates in the normal seek mode only in the final stage of interception when the target can no longer manoeuvre to shake off the missile and when it is too late to apply counter measures.

If before launching the missile from the aircraft the target is acquirable by the missile, i.e. the target is at an angle from the missile's boresight no greater than the maximum off boresight angle through which the sensor is capable of rotating then the aircraft's pilot has the option of aiming the sensor at the target before launching the missile. One way of aiming the sensor at the target before launching is by using a known per se helmet-mounted sight system. The pilot simply looks in the direction of the target and the appropriate line of sight data, defining the angular position of the target relative to boresight, is accordingly transmitted to the missile's sensor rotation control unit, which in turn rotates the sensor towards the target.

It will appreciated that according to the above embodiment of the invention all of the determination and analysis means are mounted in an aircraft.

Generally, the aircraft on which the determination and analysis means are mounted is the aircraft from which the missile was launched. Alternatively, the determination and analysis means may be mounted in an aircraft other than the aircraft from which the missile was launched. Still more generally, however, said determination and analysis means may be mounted not only on the aircraft from which the missile was launched but also on at least one other aircraft.

Apart from the hereinabove described configuration in which the line of sight and trajectory analysis means are mounted in an aircraft it is possible to mount these means on the missile, so that the role played by the aircraft is relegated to providing the missile with the target's location data, as acquired by the aircraft's radar system. In both cases it is important to stress that the guidance system of the invention involves minimal modification of the existing guidance system of the missile. In fact the only function of the guidance system of the invention is to provide line of sight data to the missile's sensor. In the non-seek mode the missile's sensor is appropriately rotated into the newly determined line of sight and in the dual mode the sensor is so rotated if required. In other words the guidance system of the invention does not transmit any data directly to the missile's steering mechanism, it only causes the sensor to change its orientation, if required.

In accordance with a second embodiment of the invention there is provided, for guiding a missile equipped with a sensor, a guidance system, comprising:

location determination means mounted in the aircraft for determining aircraft self-location data;

a radar system mounted in the aircraft for locating and tracking a target and for deriving location data of the target;

a transmitter mounted in the aircraft for transmitting said aircraft self-location data and said target location data from the aircraft to the missile;

aircraft mounted line of sight determination data means;

aircraft mounted operational mode data specification means;

a first receiver mounted in the missile for receiving said aircraft self-location data, target location data, line of sight data and operational mode data transmitted from the aircraft to the missile;

a second receiver mounted in the missile operative to receive data from Global Positioning system satellites;

location determination means mounted in the missile for determining missile self-location data from the data received from the Global Positioning System;

relative location data determination means mounted in the missile coupled to said location determination means and to said first receiver and responsive to missile self-location data and to aircraft self-location data for determining missile self-location data relative to the aircraft;

trajectory analysis means mounted in the missile coupled to said relative location determination means and to said first receiver and responsive to missile self-location and target location data for predicting the trajectory of the target and for determining the trajectory of the missile required to ensure that it will intercept the target and for determining the required operational mode of the missile;

line of sight and mode operation determination means mounted in the missile coupled to said trajectory and analysis means and responsive to the specified operational mode data, the determined operational mode data and the determined missile trajectory for deriving new sensor line of sight data required for applying to the sensor in order to guide the missile, when operating in the non-seek mode, along the determined missile trajectory; and means mounted in the missile for conveying the new sensor line of sight data to the missile's sensor rotation control unit.

As pointed out above the guidance system of the invention does not transmit specific steering data directly to the missile's steering mechanism. It merely transmits new line of sight data to the sensor's rotation control unit which appropriately rotates the sensor into the new line of sight. As a result of the rotation of the sensor a signal is sent to the missile's steering system (just as it would in a conventional missile) which, for example, activates the missiles fins. Clearly then, regardless of which embodiment is concerned no alterations in hardware are made to the missile's steering system and therefore when the guidance system of the invention is applied to a conventional missile by adding on the required modules described above the cost and work involved is less than would be if changes would have to be made in the existing missile's steering system. However, the guidance system of the invention is not restricted to adding on modules to existing missiles and aircraft. Clearly, the required modules described above can also be incorporated in.

Typically, the missile operates in the non-seek mode only in the final stage of interception when the target can no longer manoeuvre to shake off the missile and when it is too late to apply counter measures.

If desired the self-location determination means mounted in the aircraft for determining aircraft self-location data is a global positioning system receiver for receiving signals from global positioning system satellites connected to processing means for determining aircraft self-location data from the received signals.

Further if desired the self-location determination means mounted in the aircraft for determining aircraft self-location data is an inertial navigation system.

The guidance system of the invention is not bound only to these self-location determination means and a TERCOM system could equally well be utilized. As is well known, a TERCOM system determines the location of an aircraft using an inertial system, a carpet database and by measuring the height of the aircraft.

Clearly, even in the second embodiment in which the line of sight and sensor mode of operation determination means and trajectory analysis means are mounted in the missile the aircraft's pilot has the option of aiming the sensor at the target before launching the missile using a helmet-mounted sight system as described hereinbefore.

In accordance with the first embodiment of the present invention there is also provided a method for guiding, towards a target, a missile launched from an aircraft, the missile comprising a self-guidance system including a rotatable sensor capable of rotating with respect to the missile's boresight thereby generating a spatial rotation angle, a steering system responsive to said self-guidance system for re-aligning the missile so that said spatial rotation angle decreases substantially to zero; the method comprising the following steps, executed in a judicious manner;

the missile receiving data from Global Positioning System satellites;

the missile transmitting to an aircraft, sensor line of sight data and said data received from the Global Positioning System satellites;

the aircraft receiving from the missile said sensor line of sight data and Global Positioning System data received by the missile from the Global Positioning System satellites;

the aircraft determining location data of the missile from the data received by the missile from the Global Positioning System and transmitted to the aircraft thereby obtaining the present trajectory of the missile from the missile location data at successive times;

the aircraft determining self-location data;

the aircraft determining the location data of the missile relative to the location of the aircraft;

locating and tracking a target by a radar system mounted in the aircraft for deriving the location data of the target;

the aircraft predicting the trajectory of the target from said target location data;

the aircraft deriving, from the missile location data and from the predicted trajectory of the target, the trajectory of the missile required to ensure that the missile will intercept the target;

the aircraft determining, from the derived missile trajectory and the missile location data, sensor line of sight data required for applying to the missile's sensor in order to guide the missile along the determined missile trajectory;

the aircraft specifying the sensor's required mode of operation;

the aircraft transmitting said determined line of sight data and said specified sensor mode of operation data to the missile; and conveying in the missile, the determined sensor line of sight data and the specified sensor mode of operation to the missile's sensor rotation control unit, whereby the sensor is rotated into the determined line of sight if the specified sensor mode of operation indicates that this is to be done.

In accordance with the second embodiment of the present invention there is also provided a method for guiding, towards a target, a missile launched from an aircraft, the missile comprising a self-guidance system including a rotatable sensor capable of rotating with respect to the missile's boresight thereby generating a spatial rotation angle, a steering system responsive to said self-guidance system for re-aligning the missile so that said spatial rotation angle decreases substantially to zero; the method comprising the following steps, executed in a judicious manner:

location determination means mounted in the aircraft for determining the aircraft's self-location data;

the aircraft deriving location data of a target by means of a radar system mounted in the aircraft;

the aircraft's operator determining sensor line of sight data and specifying sensor mode of operation data;

transmitting said aircraft self-location data, said target location data said determined sensor line of sight data and said specified sensor mode of operation data from the aircraft to the missile;

the missile receiving from the aircraft said aircraft self-location data, target location data, determined sensor line of sight data and specified sensor mode of operation data transmitted;

the missile receiving data from Global Positioning System satellites;

the missile determining missile self-location data from the data received from the Global Positioning System;

the missile determining its self-location relative to the aircraft's location;

the missile predicting the trajectory of the target;

the missile deriving required self-trajectory to ensure that it will intercept the target;

the missile determining sensor line of sight data required to guide the missile along the derived missile self-trajectory and specifying the sensor's required mode of operation;

conveying in the missile the determined sensor line of sight data and the specified sensor's required mode of operation to the missile's sensor rotation control unit; and rotating the sensor into the determined sensor line of sight if the sensor mode of operation indicates that this is to be done.

Clearly, if the present sensor line of sight and the determined sensor line of sight are equal (apart from some tolerable error) then the sensor mode of operation will indicate that no corrective action is required and the sensor will continue to "look" in the direction determined by the sensor as it strives to maintain the target at the center of its field of view by continually updating its trajectory.

In the foregoing summary the expression "the method comprising the following steps, executed in a judicious manner" should be understood to mean that the order of executing the steps does not necessarily have to be that of the order specified. For example, "the aircraft determining location data of the missile from the data received by the missile . . . " and "the aircraft determining self-location data", could just as well be interchanged in their order to execution without changing the final output of the method.

It is appreciated that the predicted target trajectory is limited by the prediction model used. In any event, whatever model is used, situations in which the target performs manoeuvres in such a way that its trajectory changes from one predicted type of trajectory to another cannot take into account.

DETAILED DESCRIPTION OF THE INVENTION

Figure 1:
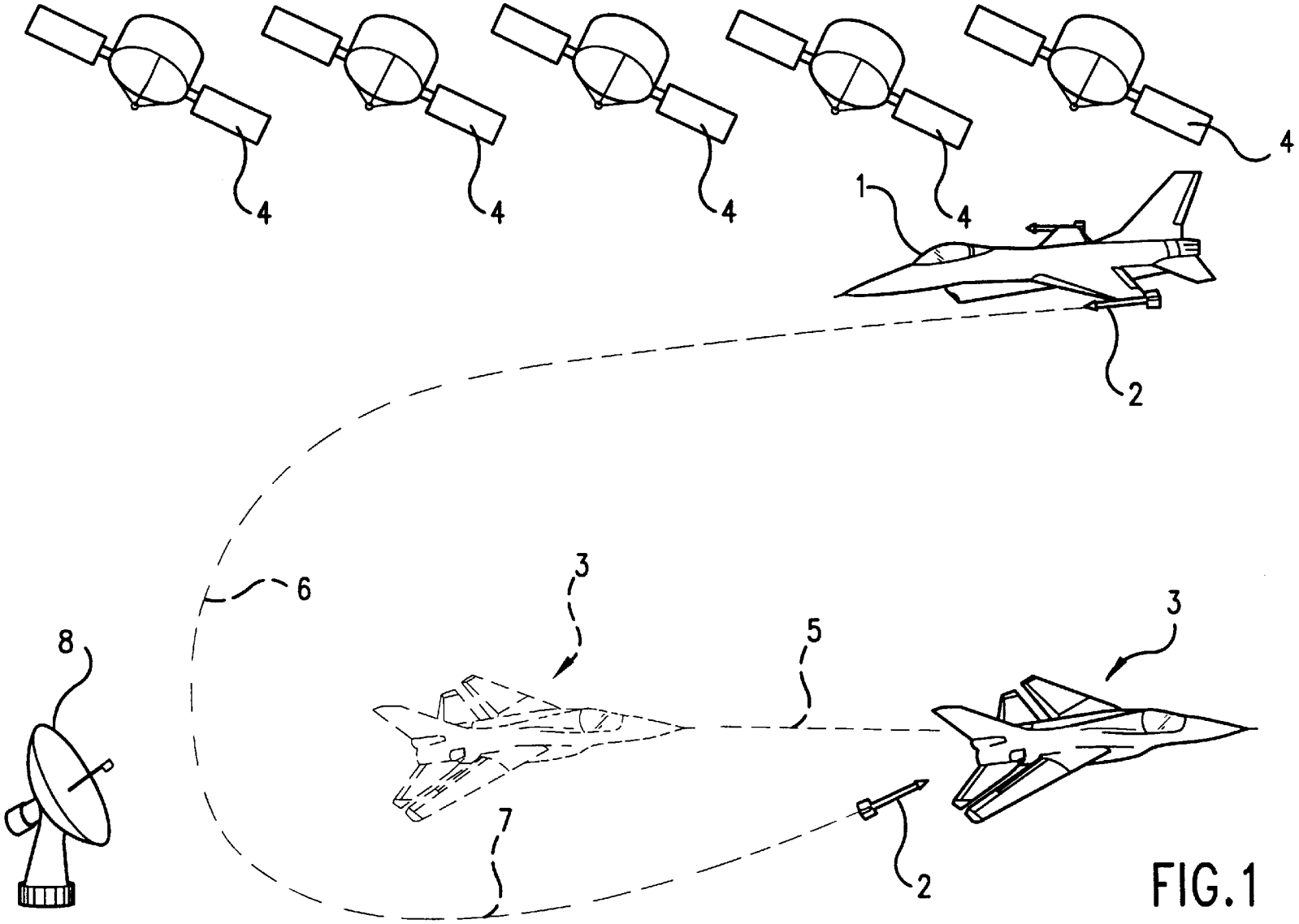
FIG. 1 is an illustration of a typical operational scenario involving the guidance system of the invention.

Referring to the drawings there is illustrated in FIG. 1 a typical operational scenario involving the guidance system of the invention operative in accordance with the principles of one embodiment of the present invention.

An aircraft 1 equipped with a missile 2, having a rotatable sensor capable of rotating with respect to the missile's boresight and a self-guidance system (both not shown), is involved in an encounter with a hostile aircraft 3, which will also be referred to as "the target". The aircraft 1 is further equipped with a radar system (not shown) and a communication channel for communicating with the missile 2. The missile employs a Global Positioning System (GPS) receiver (not shown) for receiving data from three or more GPS satellites 4, from which the location of the missile can be determined.

The aircraft 1 tracks the target 3 (shown in dashed lines) with its radar system and predicts in a known per se manner the target's future trajectory 5, from which it determines a flight path 6 required by the missile 2 in order that it intercept the target 3 at some future point in space and time (shown in continuous lines). In fact, for some missiles it is not necessary that the missile actually intercept the target. For missiles with a proximity fuse it is sufficient that they explode nearby the target. Hence a region of interception will be defined, which includes the case of interception at a point (i.e. physical collision). In general then, the missile's flight path 6 is determined so that it will intercept the target 3 at some future point in time in a region of interception. If, as shown in FIG. 1, the target 3 is outside the field of view of the missile 2 at the time of launch then the aircraft 1 transmits data to the missile 2 which, after processing, generates a signal representative of the spatial rotation angle through which the sensor is to be rotated in order to imitate the true seek mode of the sensor, even though the target is not within the field of view during the initial portion of the missile's flight path. As a result of the rotation of the missile's sensor an appropriate signal is conveyed to the missile's steering system, just as it would in the normal seek mode when the target is within the field of view of the sensor. The steering system responds by appropriately re-aligning the missile whereby the spatial rotating angle of the sensor decreases to zero and the missile is directed along the flight path 6.

At a certain point 7, along the missile's flight path 6, the target enters the field of view of the sensor and from that point on guidance control can be transferred to the self-guidance system of the missile and the sensor can operate in the normal seek mode using its self-guidance system wherein it continuously rotates to keep the target on boresight and, as described above, the steering system responds by directing the missile along the flight path until the missile 2 finally intercepts the target 3. It is not imperative that the missile's flight path 6 be determined right up to the region of interception. In such a case guidance control can be transferred to the self-guidance system of the missile either before it reaches the final point of the determined flight path or at the final point.

Even when the sensor operates in the normal seek mode the aircraft 1 continues to provide the missile with data for rotating the missile's sensor is oriented in the direction determined by the aircraft 1 then the data received from the aircraft will not cause any further rotation of the sensor. However, if at some stage of the missile's flight it locks on to a decoy countermeasure or on to a friendly aircraft, its flight path will deviate from the determined optimal flight path 6. Should this happen the data received from the aircraft will indicate a line of sight ("determined line of sight") for the sensor which is different from the sensor's actual present line of sight. In this event the determined line of sight overrides the present line of sight and the sensor is rotated into the former. As clarified hereinbefore this mode of operation wherein the missile operates in the seek mode but at the same time receives determined sensor line of sight data from the aircraft is termed the dual-seek mode.

The guidance system of the invention thus not only provides an optimal flight path for the missile, determined such that it will intercept a target, but it also provides an inherent flight path correction mechanism which is effectively a counter counter-measure against decoys and also serves as a safeguard against friendly fire. Additionally, for a missile equipped with an infra-red seeking sensor the guidance system of the invention also enables the missile to home on to the target even in adverse weather conditions in which the missile "looses sight" of the target (due to rain, clouds, sandstorms etc., which absorb or scatter the infra-red signal emitted by the target) and causes its flight path to deviate from the determined light path 6. This is done in the manner described above, wherein the sensor line of sight as determined by the aircraft will be used by the missile as long as the sensor's actual present line of sight is different from the determined sensor line of sight.

Also shown in FIG. 1 is a radar antenna 8, connected to a ground radar system (not shown). The ground radar system can clearly only be used within the range of its radar, that is, over friendly territory or within its vicinity. Despite this disadvantage it is particularly useful for defensive combats in which an enemy aircraft has managed to penetrate the air space over the territory being defended. The ground radar system can take over the role of the radar system in the aircraft 1, especially in situations in which the aircraft 1 loses communication with the missile 2, or when its radar "loses sight" of the target 3.

It should be noted that when there is more than one friendly aircraft participating in the combat, they are in communication with each other and with the ground station (if there is one) and constantly updating each other as to their location. This being the case, it is clear that of all the objects detected by a friendly aircraft's radar system (or the ground's radar system) the friendly aircraft can always be differentiated from enemy aircraft since the locations of each friendly aircraft is known by each participant.

Although the basic operation of the guidance system of the invention has been illustrated in FIG. 1 for the case in which the determined sensor line of sight is provided by the aircraft 1 from which the missile was launched, this should not be interpreted as binding. Just as the ground radar system 8 can take over the role of the radar system of aircraft 1 so can the radar system of another friendly aircraft.

Figure 2:
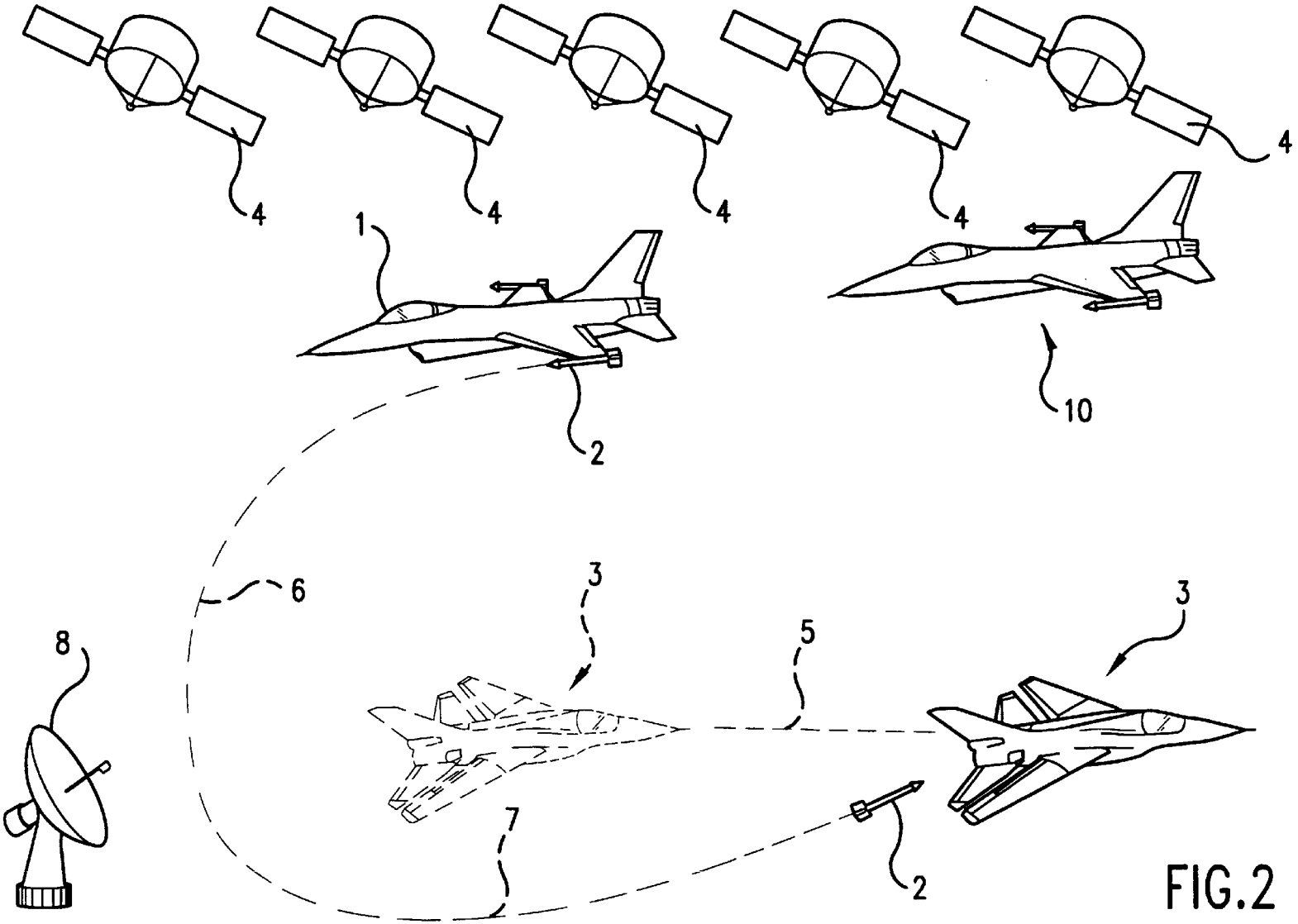
FIG. 2 is an illustration of a situation in which the missile is launched from one friendly aircraft but where the sensor line of sight data is determined by a second friendly aircraft.

FIG. 2 illustrates a situation in which the missile 2 is launched from friendly aircraft 1 but where the sensor line of sight data is determined by a second friendly aircraft 10 and transmitted by it to the missile 2. In this embodiment the second friendly aircraft 10 completely takes over the role played by friendly aircraft 1 as soon as the missile 2 is launched. That is, it is the second friendly aircraft 10 that tracks the target 3 with its radar system and predicts the target's future flight path 5, from which it determines the optimal flight path 6 required by the missile 2 in order that it intercept the target 3 at some future point in time.

In general, a plurality of friendly aircraft can participate in the guidance system of the invention, wherein the aircraft are in communication with each other in a manner described in Israel Patent Application no. 115595, which is incorporated herein by reference and which describes an air combat monitoring system which utilizes radar and communication systems mounted in a plurality of aircraft for, amongst other things, classifying aircraft within radar and communication range as friendly or foe.

Figure 3:
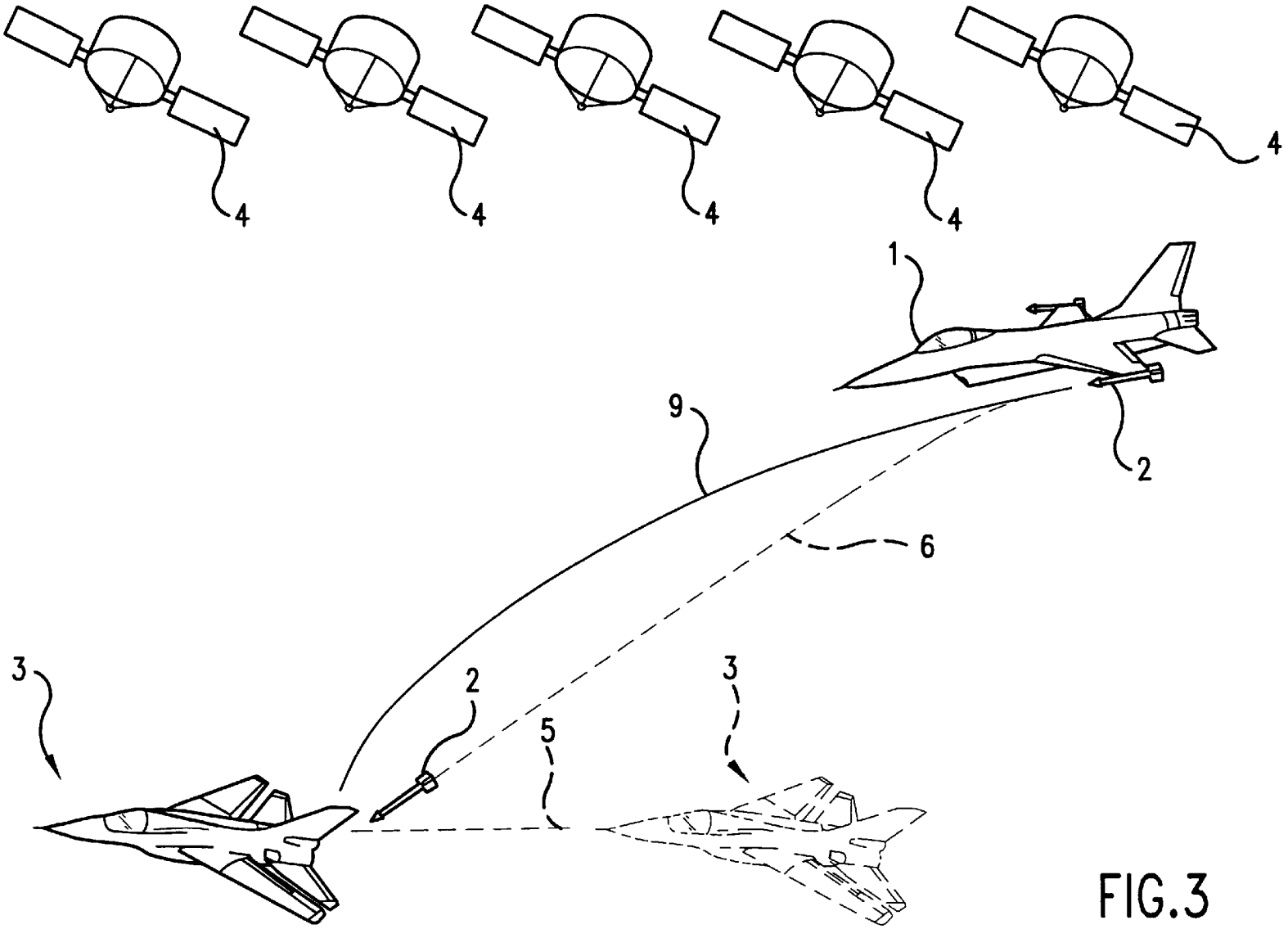
FIG. 3 is an illustration of the case in which the enemy aircraft is in the field of view of the missile's sensor at the time of launch.

It is evident that, whereas the underlying principles of the operation of the guidance system of the invention have been illustrated for the case in which the enemy aircraft is outside the field of view of the missile's sensor before launch, it equally well applies to the case in which the enemy aircraft is in the field of view of the missile's sensor at the time of launch. As shown in FIG. 3 for the case in which the enemy aircraft is in the field of view of the missile's sensor at the time of launch the optimal flight path 6 of the missile 2 may well turn out to be a straight line, apart from an initial turn into the straight line flight path just after launch, whereas the flight path 9 that the missile would take if it were to use its self-guidance system would be curved and therefore longer.

Whilst the description illustrated three specific battle scenes in which the guidance system of the invention is utilized, those versed in the art will readily appreciate that these are only three out of many possible scenarios. Thus, by way of one limiting example, two or more friendly aircraft may cooperate in order to provide the missile with the required line of sight data in order that it intercept the target.

Figure 4:
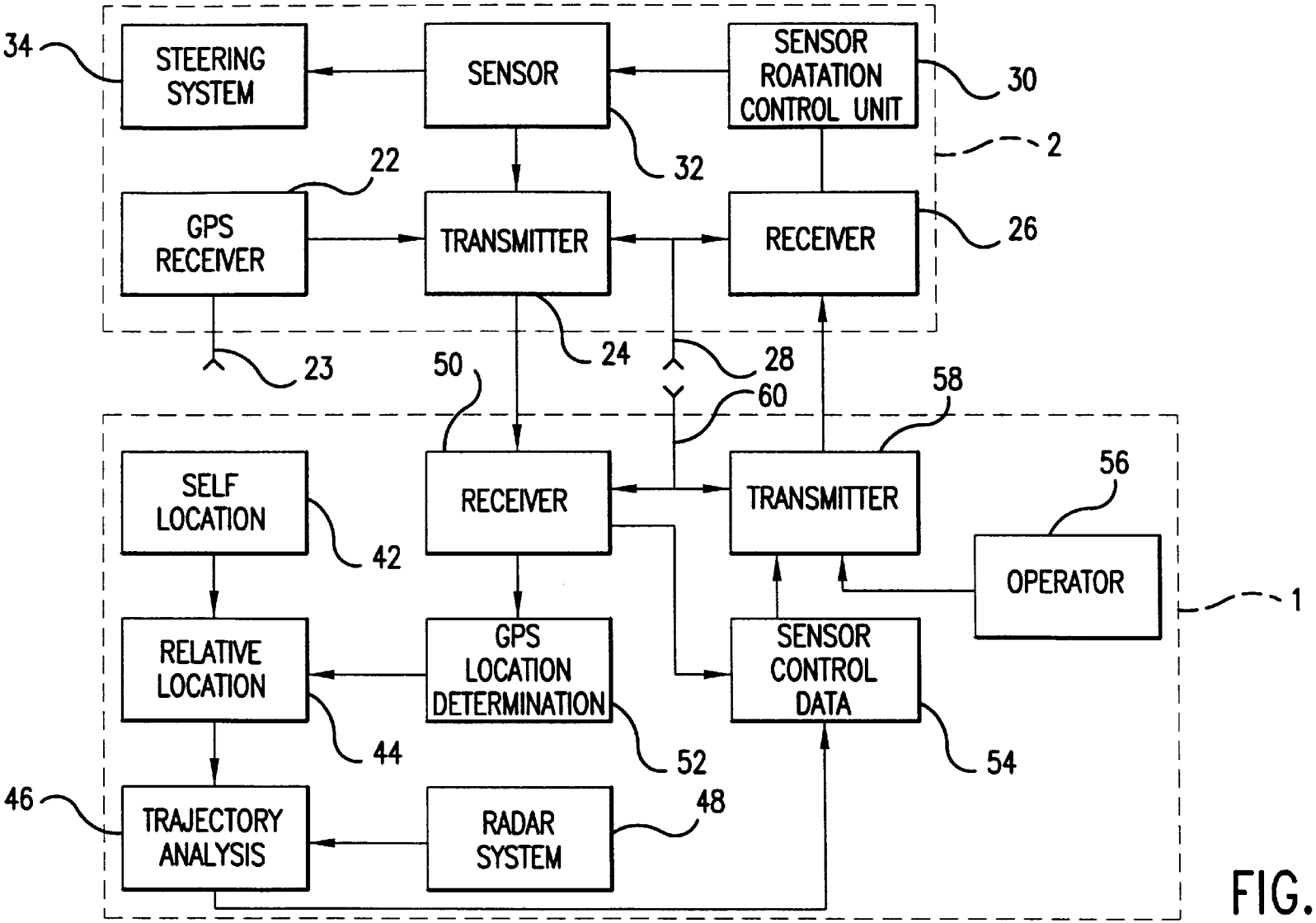
FIG. 4 is a block diagram showing schematically the configuration and connections of the components of the guidance system of the invention according to one embodiment.

FIG. 4 is a block diagram showing schematically the configuration and connections of the components of the guidance system of the invention according to one embodiment. The missile 2 can be any known missile with a sensor to which the following three new modules are retrofitted: a GPS receiver 22 and its associated antenna 23, a transmitter 24 and a receiver 26. The transmitter 24 and the receiver 26 are connected to a common antenna 28. Basically, then, this embodiment involves a minimum of additional equipment to an existing missile. On the other hand the aircraft 1, to which the missile 2 is mounted before launch, bears the burden of most of the additional equipment required according to this embodiment. Self-location determination means 42 is, in the preferred embodiment an already existing inertial reference unit for computing the aircraft location. However, it could also be a GPS receiver, in which case it would have an associated antenna and it would be connected to the GPS location determination means 52.

The receiver 50, sharing a common antenna 60 with the transmitter 58, receives from the missile GPS data as received by the missile's GPS receiver 22. The GPS data is inputted to the GPS location determination means 52 where the location of the missile is determined by techniques known per se. Relative location determination means 44 determines the location of the missile relative to the aircraft from the location determinations data conveyed to it from units 42 and 52.

The radar system 48 tracks and locates the target and performs a series of location measurements, obtaining a series of values for the spatial position and velocity of the target relative to the aircraft. This location data of the target is relayed to the trajectory analysis means 46, to which is also inputted the relative location data of the missile. From the values of the location data of the target and of the missile over a given time period the trajectory analysis means 46 predicts the future flight path of the target (for example, by linear interpolation) and determines the optimal flight path required of the missile to ensure that the missile will intercept the target at a specified point along the predicted flight path of the target.

The determined required flight path data of the missile (i.e. the coordinates of the points describing the flight path) are transmitted to the line of sight and sensor mode of operation determination means 54, where the line of sight of the missile's sensor along the required flight path is determined. The determined sensor line of sight is that direction in which the sensor should be orientated in order to ensure that the missile will in fact move along the determined optimal flight path. Unit 54 also receives present sensor line of sight data as transmitted by the missile's transmitter 24, via the antenna 28, and received by receiver 50 via antenna 60.

The present sensor line of sight and the determined sensor line of sight are compared in unit 54 and if the difference between them is greater than a predetermined value (dependent on the specific missile's performance) then unit 54 indicates that the missile's sensor will be rotated into the determined sensor line of sight and not that provided by the missile's self-navigation system. To this end, unit 54 specifies a sensor mode of operation index which, together with the determined sensor line of sight data is transmitted by transmitter 58, via antenna 60, to the missile where it is received by receiver 26 via antenna 28.

In the normal seek mode the sensor rotation control unit 30 rotates the sensor into the sensor line of sight determined by the missile's self-navigation system. However, upon receiving a mode of operation index indicating that the missile is to operate in the "non-seek mode", the sensor rotation control unit 30 will rotate the sensor 32 only according to the line of sight determined by unit 54 and received by receiver 26, and will completely ignore the line of sight determined by the missile's self-navigation system. If, on the other hand, sensor rotation control unit 30 receives a mode of operation index indicating that the missile is to operate in the "dual seek mode" then it will rotate the sensor 32 into the line of sight determined by the missile's self-navigation system unless the sensor mode of operation index indicates that the line of sight determined by unit 54 should be used. In order words, there are two mode of operation indices for the dual mode; one establishing that the line of sight determined by the missile's self-navigation be used to rotate the sensor and the other establishing that the line of sight determined by unit 54 be used.

Whatever the origin of the sensor's new orientation the result is always the same, namely that a signal corresponding to the sensor's desired spatial rotation angle through which the sensor should rotate from its previous line of sight to its new line of sight is transmitted to the steering system 34 which in turn guides the missile along the appropriate flight path.

Module 56 represents the operator determined pre-launch sensor line of sight apparatus and comprises a helmet-mounted sight system known per se connected to the missile. This module is used if the target is within the maximum off-boresight angle rotation of the sensor. At launch, the operator (pilot) looks in the direction of the target and the corresponding look angle data is transmitted to missile along with a dual mode of operation index for the sensor mode of operation. As a result the sensor rotates into the direction of the target and the missile can then be launched. The operation of module 56 is known per se and therefore will not be expounded upon herein.

Figure 5:
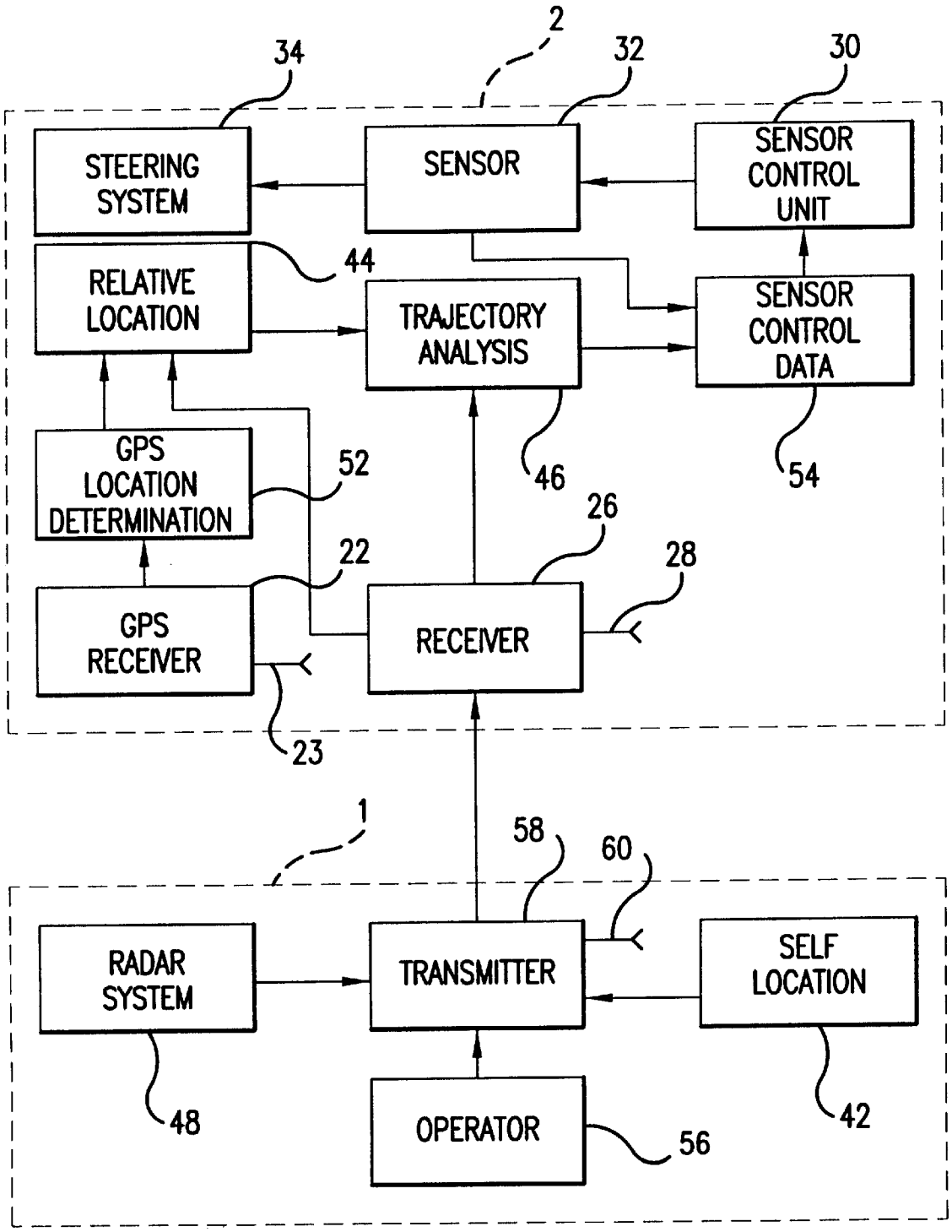
FIG. 5 is a block diagram showing schematically the configuration and connections of the components of the guidance system of the invention according to another embodiment.

Attention is now drawn to FIG. 5 showing schematically, in block diagram form, the configuration and connections of the components of the guidance system of the invention according to another embodiment. As can be seen by comparing FIGS. 4 and 5, the differences between the two embodiments as far as the hardware is concerned can be summarized as follows: the missile's transmitter 24 and the aircraft's receiver 50 of the embodiment illustrated in FIG. 4 are no longer required and are removed from the system. The following four units which are located in the aircraft in FIG. 4 are removed from the aircraft and mounted in the missile in FIG. 5: relative location determination means 44, trajectory analysis means 46, GPS location determination means 52 and line of sight and sensor mode of operation determination means 54. In accordance with this embodiment the aircraft 1 (or another friendly aircraft) provides the missile with the aircraft's self-location data and with the target's location data as acquired by the aircraft's radar system. In this embodiment the aircraft itself is not required to carry out any form of processing of the data since all the determination and analysis means are now mounted in the missile. Those versed in the art will readily appreciate that the embodiments of the invention illustrated in FIGS. 4 and 5 are only two out of many possible embodiments, where the various other embodiments would differ by where the various modules are located, i.e., by transferring different combinations of modules from the aircraft to the missile and vice versa. It will also be appreciated that various of the modules could be combined, and that modules illustrated in FIGS. 4 and 5 have been chosen merely for illustrative purposes in order to distinguish between the various functions involved in the guidance system of the invention.

In FIG. 5 the aircraft 1, or another friendly aircraft, tracks the target with its radar system 48 and transmits the resulting target location data (i.e. the spatial position and velocity of the target relative to the aircraft) and the aircraft's self-location data via transmitter 58 and associated antenna 60 to the missile. The data is received by the missile's receiver 26 via its antenna 28. GPS data is received by the missile's GPS receiver 22 via antenna 23. The GPS data is inputted to the GPS location determination means 52 where the location of the missile is determined by techniques known per se. Relative location determination means 44 determines the location of the missile relative to the aircraft from the data conveyed to it from unit 52 and receiver 26. From the values of the location data of the target and of the missile over a given period of time the trajectory analysis means 46 predicts the future flight path of the target and determines the optimal flight path required of the missile to ensure that it will intercept the target at a specified point along the predicted flight path of the target. The determined required flight path data of the missile are transmitted to the line of sight and sensor mode of operation determination means 54, where the line of sight of the missile's sensor along the required flight path is determined. Unit 54 also receives present sensor line of sight data directly from the sensor 32. The present sensor line of sight data and the determined sensor line of sight data are compared in unit 54. If the difference between the two is greater than a predetermined value then unit 54 provides the sensor rotation control unit with the determined sensor line of sight data and a sensor mode of operation index indicating that the missile's sensor is to be rotated into the determined sensor line of sight and not that provided by the missile's self-navigation system.

If the target is within the maximum off-boresight angle of rotation of the sensor before the missile is launched from the aircraft then the operator (pilot) looks in the direction of the target and the corresponding look angle data is transmitted to the missile along with a dual mode of operation index for the sensor mode of operation by module 56 via transmitter 58.

Figure 6:
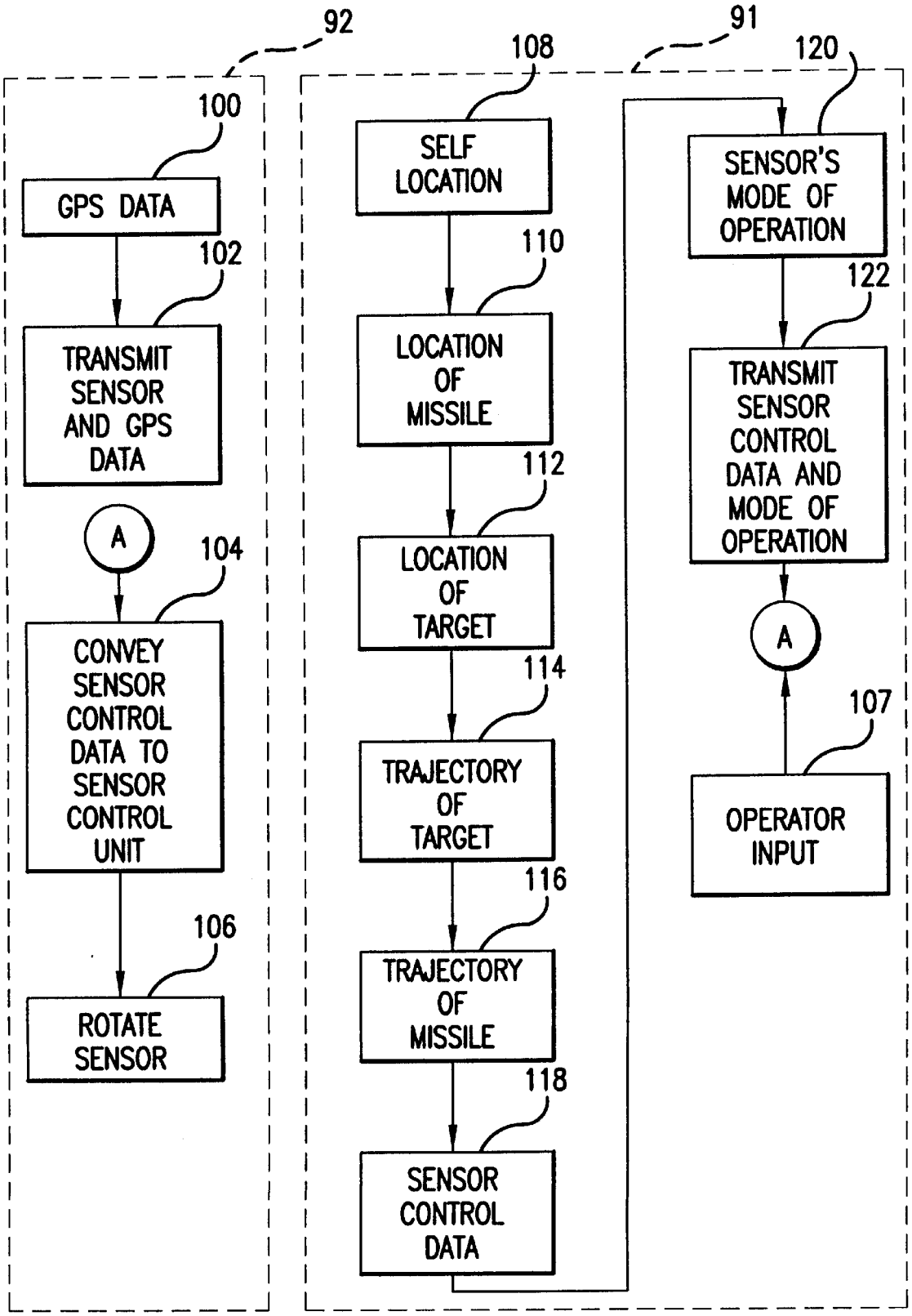
FIG. 6 is a flow diagram showing the steps in the method of the guidance system of the invention according to the embodiment shown in FIG. 4.

Attention is now drawn to FIG. 6 showing the method of the invention according to the embodiment illustrated in FIG. 4. Those steps that are carried out within the aircraft are enclosed within dashed box 91, whereas those steps carried out within the missile are enclosed within dashed box 92. As previously pointed out, it should be appreciated that the order of executing the steps does not necessarily have to be that of the order specified. Step 107 is a pre-launch step and is included if the pilot is equipped with a helmet-mounted sight and if the target is at an angle off-boresight that is less than the maximum off-boresight angle attainable by the sensor. If this situation arises the pilot of the aircraft looks in the direction of the target and by means of the helmet-mounted sight the appropriate sensor line of sight is determined and the sensor mode of operation index is set to the seek mode. The pilot initiates the launching process by depressing an appropriate button and the aircraft transmits to the missile the sensor line of sight data and sensor mode of operation index. At step 100 the missile receives data from GPS satellites which, at step 102, it transmits to the aircraft along with data representative of the present line of sight of the missile's sensor. At step 108 the aircraft determines its self location data preferably using an inertial reference unit, but alternatively using GPS data received from GPS satellites. At step 110 a processor determines the location of the missile relative to that of the aircraft. The aircraft's radar system locates and tracks a target at step 112 and determines the target's location data. At step 114 a processor predicts the trajectory of the target from the target location data as determined by the aircraft radar system. At step 116 the processor determines the flight path of the missile required to ensure that the missile will intercept the target at some future point in time. From the missile's present location and the predicted trajectory of the target the sensor's line of sight necessary to ensure that the missile will move along the flight path determined for interception with the missile is calculated at step 118. The sensor's present line of sight and its determined line of sight are compared at step 120 in order to specify a sensor mode of operation index. At step 122 the aircraft transmits the new line of sight data and the specified sensor mode of operation index to the missile, which in turn at step 104 conveys this data to the sensor rotation control unit. Finally, in step 106 the sensor is rotated into a determined line of sight. If the sensor mode of operation index indicates a normal seek mode or a dual seek mode with the index indicating that the present and determined sensor line of sights are equal, then the sensor will be rotated by an amount determined by the self-navigation system of the missile. If on the other hand the sensor mode of operation index indicates a non-seek mode or a dual seek mode wherein the determined and present line of sights are different, then the sensor is rotated in into the line of sight determined by the system of the invention.

Figure 7:
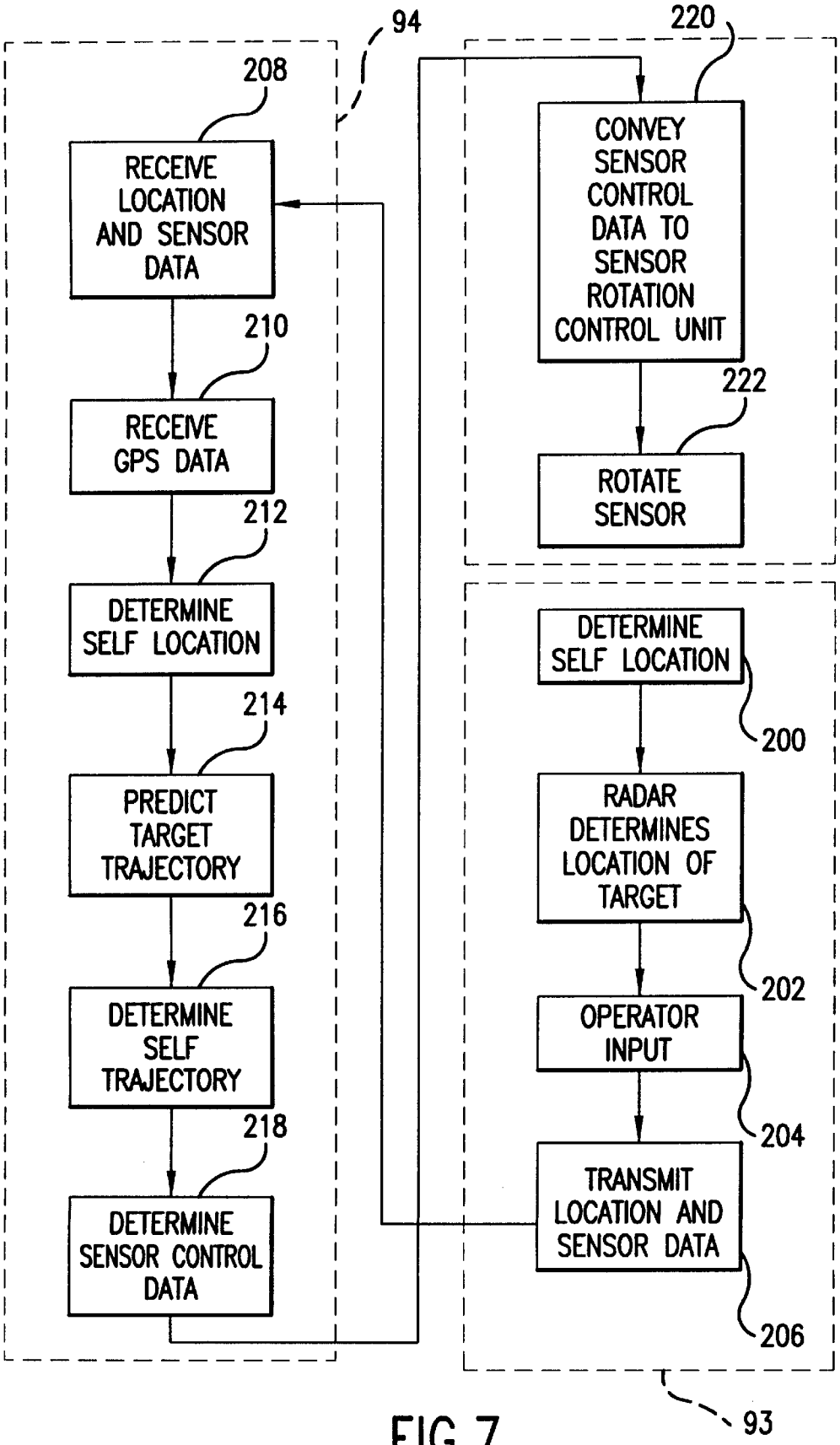
FIG. 7 is a flow diagram showing the steps in the method of the guidance system of the invention according to the embodiment shown in FIG. 5.

Attention is no drawn to FIG. 7 illustrating the method of the invention for the embodiment of the system shown in FIG. 5. Those operations performed in the aircraft are enclosed in dashed box 93 whereas those operations performed in the missile are enclosed within dashed box 94. As with the steps described in FIG. 6 it should be appreciated that the order of executing the steps described in FIG. 7 does not necessarily have to be that of the order specified. At step 200 the aircraft determines its self-location, preferably by means of an inertial reference unit or alternatively using the GPS receiver and a GPS location determination means. A target is detected and tracked by means of the aircraft radar system at step 202 which also determines the location data of the target. Step 204 is a pre-launch step and is included if the pilot is equipped with a helmet-mounted sight and if the target is at an angle off-boresight that is less than the maximum off-boresight angle attainable by the sensor. If this situation arises the pilot of the aircraft looks in the direction of the target and by means of the helmet-mounted sight the appropriate sensor line of sight is determined and the sensor mode of operation index is set to the seek mode. The pilot initiates the launching process by depressing an appropriate button and the aircraft transmits to the missile the sensor line of sight data and sensor mode of operation index at step 206. All the data transmitted by the aircraft at step 206 is received by the missile at step 208. At step 210 the missile receives data from GPS satellites which are processed in step 212 to determine the missile's self location data. From the received target location data the trajectory of the target is predicted in step 214, and in step 216 the missile determines the flight path that it would have to take in order to ensure that it will intercept the target at some future time. Having determined its self flight path to ensure interception with the target the sensor line of sight required to guide the missile along the determined flight path is determined in step 218. The processor used in step 218 then compares the determined sensor line of sight with the present sensor line of sight in order to specify the sensor mode of operation index in order to ensure in fact that the missile will move along the determined required self flight path. At step 220 the determined sensor line of sight along with the specified sensor mode of operation index is transmitted to the sensor rotation control unit. At step 222 the sensor is then either rotated into the line of sight determined by the guidance system of the invention or by the self guidance system of the missile depending on the value of the sensor mode of operation index.

I claim:

1. A method for guiding, towards a target, a missile launched from an aircraft, the missile comprising a self-guidance system including a rotatable sensor capable of rotating with respect to the missile's boresight thereby generating a spatial rotation angle, a steering system responsive to said self-guidance system for re-aligning the missile so that said spatial rotation angle decreases substantially to zero; the method comprising the following steps:

(i) predicting the trajectory of the target on the basis of at least a series of location measurements of the target;

(ii) estimating a missile's flight path, on the basis of at least a series of location determinations of the missile and on said predicted trajectory such that the missile will intercept the target at some future point in time if the missile follows at least a portion of said estimated flight path; and (iii) generating successively a series of signals, each indicative of a desired rotation angle through which the sensor should rotate so as to cause said missile to follow part or all of said flight path, said target being outside the field of view of the missile during at least a portion of said flight path.

2. The method according to claim 1, wherein said missile's flight path is estimated to a region of interception.

3. The method according to claim 2, further comprising the step of:

(iv) transferring control to said self-guidance system, for ensuring that the missile duly intercepts said target.

4. The method of claim 3, wherein said location measurement of the target includes a position and a velocity of the target.

5. The method according to claim 1, wherein said missile's flight path is estimated to a point before a region of interception, and wherein said method further comprises the step of:

(iv) transferring control to said self-guidance system, for ensuring that the missile duly intercepts said target.

6. The method according to claim 5, wherein at said point the target is in the field of view of the sensor.

7. The method according to claim 6, wherein said step (i) includes:

(i).1 performing at least a series of measurements to acquire location data of the target and;

(i).2 predicting the trajectory of said target based on said acquired location data.

8. The method according to claim 7, wherein said at least a series of location measurements of the target are acquired by a radar system.

9. The method according to claim 8, wherein said radar system is mounted in said aircraft.

10. The method according to claim 8, wherein said radar system is mounted in another aircraft capable of communicating with said aircraft.

11. The method according to claim 8, wherein said radar system is a ground radar.

12. The method according to claim 1, wherein:

said predicting and estimating steps are performed by trajectory analysis means mounted in said aircraft, said series of location determinations of the missile is performed by location determination means mounted in the aircraft based on data representative of the missile's location transmitted from the missile to the aircraft, and said signals indicative of a desired rotation angle through which the sensor should rotate are determined in the aircraft and transmitted to the missile.

13. The method according to claim 1, wherein:

said predicting and estimating steps are performed by trajectory analysis means mounted in said missile, said series of location determinations of the missile is performed by self-location determination means mounted in the missile, and said signals indicative of a desired rotation angle through which the sensor should rotate are determined in the missile.

14. The method according to claim 1, wherein control is transferred to said self-guidance system and said signals indicative of a desired rotation angle through which the sensor should rotate are compared to signals indicative of the rotation angle of the sensor as determined by the self-guidance system.

15. The method according to claim 14, wherein control is transferred to the self-guidance system when said signals indicative of a desired rotation angle through which the sensor should rotate are different from the signals indicative of the rotation angle of the sensor as determined by the self-guidance system.

16. The method according to claim 1, wherein said sensor is a passive infrared sensor.

17. The method according to claim 1, wherein said sensor is a radar system.

18. A method for guiding, towards a target, a missile launched from an aircraft, the missile comprising a self-guidance system including a rotatable sensor capable of rotating with respect to the missile's boresight thereby generating a spatial rotation angle, a steering system responsive to said self-guidance system for re-aligning the missile so that said spatial rotation angle decreases substantially to zero; the method comprising the following steps:

receiving at the missile data from Global Positioning System satellites;

transmitting sensor line of sight data and said data received from the Global Positioning System satellites from the missile to an aircraft;

receiving at the aircraft from the missile said sensor line of sight data and Global Positioning System data received at the missile from the Global Positioning System satellites;

determining at the aircraft missile location data of the missile from the data received at the missile from the Global Positioning System and transmitted to the aircraft to obtain a present trajectory of the missile from the missile location data at successive times;

determining at the aircraft self-location data defining a location of the aircraft;

determining at the aircraft the location data of the missile relative to the location of the aircraft;

locating and tracking a target by a radar system mounted in the aircraft for deriving target location data of the target;

predicting at the aircraft trajectory of the target from said target location data;

deriving at the aircraft, from the missile location data and from the predicted trajectory of the target, a derived trajectory of the missile required to ensure that the missile will intercept the target;

determining at the aircraft, from the derived missile trajectory and the missile location data, sensor line of sight data required for applying to the missile's sensor in order to guide the missile along the derived missile trajectory;

specifying at the aircraft a mode of operation of the sensor;

transmitting from the aircraft said determined sensor line of sight data and said specified sensor mode of operation to the missile; and inputting, in the missile, the determined sensor line of sight data and the specified sensor mode of operation to the missile's sensor rotation control unit, the sensor being rotated into the determined line of sight depending on the specified sensor mode of operation.

19. A method for guiding, towards a target, a missile launched from an aircraft, the missile comprising a self-guidance system including a rotatable sensor capable of rotating with respect to the missile's boresight thereby generating a spatial rotation angle, a steering system responsive to said self-guidance system for re-aligning the missile so that said spatial rotation angle decreases substantially to zero; the method comprising the following steps:

determining aircraft self-location data of a location of the aircraft;

deriving at the aircraft target location data of a target by means of a radar system mounted in the aircraft;

determining at the aircraft present sensor line of sight data;

specifying at the aircraft present sensor mode of operation data of the sensor;

transmitting said aircraft self-location data, said target location data, said present sensor line of sight data and said specified present sensor mode of operation data from the aircraft to the missile;

receiving at the missile said aircraft self-location data, said target location data, said present sensor line of sight data and said specified present sensor mode of operation data from the aircraft;

receiving at the missile data from Global Positioning System satellites;

determining at the missile first missile self-location data from the data received from the Global Positioning System; determining at the missile second self-location data of the missile relative to the location of the aircraft;

predicting at the missile a trajectory of the target;

determining at the missile a missile self-trajectory to ensure that the missile will intercept the target;

determining at the missile sensor line of sight data required to guide the missile along the derived missile self-trajectory;

specifying at the missile sensor mode of operation data of the sensor;

inputting the determined sensor line of sight data and the specified sensor mode of operation data to the missile's sensor rotation control unit; and rotating the sensor the determined sensor line of sight data based on the present sensor line of sight data instead of in response to the sensor mode of operation data.

20. A system for guiding, towards a target, a missile launched from an aircraft, the missile comprising a self-guidance system including a rotatable sensor, a sensor rotation control unit and a steering system, comprising:

trajectory prediction means for predicting a predicted trajectory of the target on the basis of at least a series of location measurements of the target and for estimating a flight path of the missile on the basis of at least a series of location determinations of the missile and on said predicted trajectory such that the missile will intercept the target at some future point in time of the missile follows at least a portion of said estimated flight path; and line of sight and sensor mode of operation determination means for generating successively a series of signals, each indicative of a desired rotation angle through which the sensor should rotate so as to cause said missile to follow at least a part of said flight path, said target being a field of view of the missile during at least a portion of said flight path.

21. The system according to claim 20, wherein said at least a series of location measurements of the target are acquired by a radar system.

22. The system according to claim 21, wherein said radar system is mounted in said aircraft.

23. The system according to claim 21, wherein said radar system is mounted in another aircraft capable of communicating with said aircraft.

24. The system according to claim 21, wherein said radar system is a ground radar.

25. The system according to claim 20, wherein said trajectory analysis means mounted, said self-location determination means, and said line of sight and sensor mode of operation determination means are mounted in the missile.

26. A system for guiding, towards a target, a missile launched from an aircraft, the missile comprising a self-guidance system including a rotatable sensor, a sensor rotation control unit and a steering system, comprising:

a Global Positioning receiver mounted in the missile for receiving data from Global Positioning System satellites;

a transmitter mounted in the missile for transmitting to an aircraft, sensor line of sight data and said data received from the Global Positioning System satellites;

a receiver mounted in the aircraft for receiving from the missile said sensor line of sight data and Global Positioning System data received by the missile from the Global Positioning System satellites;

Global Positioning System location determination means mounted in the aircraft for determining location data of the missile from the data received by the missile from the Global Positioning System and transmitted to the aircraft;

self-location determination means mounted in the aircraft for determining a location of the aircraft;

relative location determination means mounted in the aircraft for determining the location data of the missile relative to the location of the aircraft;

a radar system for locating and tracking a target and for deriving location data of the target;

trajectory analysis means mounted in the aircraft for predicting a trajectory of the target and a trajectory of the missile required to ensure that the missile will intercept the target;

line of sight and sensor mode of operation determination means mounted in the aircraft;

a transmitter mounted in the aircraft for transmitting line of sight data and sensor mode of operation data to the missile;

a receiver mounted in the missile for receiving the line of sight data and the sensor mode of operation data from the aircraft; and a line of sight and sensor mode of operation determination unit mounted in the aircraft.

27. The system according to claim 26, wherein said radar system is mounted in said aircraft from which the missile was launched.

28. The system according to claim 26, wherein said radar system is mounted in an aircraft other than the aircraft from which the missile was launched.

29. The system according to claim 28, wherein said aircraft other than the aircraft from which the missile was launched is capable of communicating with said aircraft from which the missile was launched.

30. The system according to claim 26, wherein said radar system is a ground radar.

31. The system according to claim 26, wherein said sensor is a passive infrared sensor.

32. The system according to claim 26, wherein said sensor is a radar system.

33. The system according to claim 26, wherein said self-location determination means is a Global Positioning System receiver and Global Positioning System location determination means.

34. The system according to claim 26, wherein said self-location determination means is an inertial reference unit.

35. A system for guiding, towards a target, a missile launched from an aircraft, the missile comprising a self-guidance system including a rotatable sensor, a sensor rotation control unit and a steering system, comprising:

a Global Positioning receiver mounted in the missile for receiving data from Global Positioning System satellites;

Global Positioning System location determination means mounted in the missile for determining location data of the missile from the data received from the Global Positioning System;

self-location determination means mounted in the aircraft for determining self-location data defining a location of the aircraft;

relative location determination means mounted in the missile for determining location data of the missile relative to the location of the aircraft;

a radar system for locating and tracking a target and for deriving location data of the target;

trajectory analysis means mounted in the missile for predicting a trajectory of the target and a self-trajectory of the missile required to ensure that the missile will intercept the target;

line of sight and sensor mode of operation determination means mounted in the missile;

a line of sight and sensor mode of operation determination unit mounted in the aircraft that determines line of sight and sensor mode of operation;

a transmitter mounted in the aircraft for transmitting the self-location data, target location data and the line of sight and sensor mode of operation data to the missile; and a receiver mounted in the missile for receiving the aircraft self-location data the target location data, the line of sight data and the sensor mode of operation data from the aircraft.

* * * * *

UNITED STATES PATENT AND TRADEMARK OFFICE

CERTIFICATE OF CORRECTION

PATENT NO. : 5,938,148
DATED : August 17, 1999
INVENTOR(S) : Itai ORENSTEIN

It is certified that error appears in the above-identified patent and that said Letters Patent is hereby corrected as shown below:

"The Specification beginning at line 25, column 6 and ending at line 30, column 6 should read as follows:"

. . . guidance system of the invention is not restricted to adding on modules to existing missiles and aircraft.

Typically, the missile operates in the non-seek mode only in the final stage of interception when the target can no. . ."

Signed and Sealed this

Eleventh Day of July, 2000

*Attest:*

Q. TODD DICKINSON

*Attesting Officer*

*Director of Patents and Trademarks*